US005611680A

United States Patent [19]

Small et al.

[11] Patent Number: 5,611,680

[45] Date of Patent: Mar. 18, 1997

[54] SPOOL ASSEMBLY FOR FIELD ADJUSTABLE COLUMN LENGTH PUMP SYSTEMS

[75] Inventors: Dorsey D. Small, Port Byron, Ill.; Diane E. Aitken, Bettendorf, Iowa

[73] Assignee: The Marley Company, Mission, Kans.

[21] Appl. No.: 572,871

[22] Filed: Dec. 18, 1995

[51] Int. Cl.[6] ..... F04B 17/00

[52] U.S. Cl. ..... 417/422; 174/47

[58] Field of Search ..... 417/422; 174/47

[56] References Cited

U.S. PATENT DOCUMENTS

| | | | |
|---|---|---|---|
| Re. 31,445 | 11/1983 | Carter . | |
| 368,654 | 8/1887 | Crosby . | |
| 3,041,977 | 7/1962 | Boyd | 417/422 X |
| 3,621,447 | 11/1971 | Taylor et al. . | |
| 3,688,015 | 8/1972 | Graybill . | |
| 3,818,116 | 6/1974 | Kuljian . | |
| 3,965,526 | 6/1976 | Doubleday . | |
| 4,138,178 | 2/1979 | Miller et al. . | |
| 4,337,969 | 7/1982 | Escaron et al. . | |
| 4,500,263 | 2/1985 | Mohn . | |
| 5,102,012 | 4/1992 | Foster . | |
| 5,145,007 | 9/1992 | Dinkins . | |
| 5,168,748 | 12/1992 | Flora, Jr. et al. . | |
| 5,269,377 | 12/1993 | Martin . | |
| 5,334,801 | 8/1994 | Mohn . | |

*Primary Examiner*—Richard E. Gluck

*Attorney, Agent, or Firm*—Kokjer, Kircher, Bowman & Johnson

[57] ABSTRACT

A spool assembly which provides for field adjustment of the column length in a pumping system such as that used in gasoline dispensing. The spool assembly is installed between a submersible electric pump and a discharge head. The spool assembly includes a head spool, a base spool and a column pipe which connects the head and base spools. The spools have electrical connectors which automatically make electrical connection to supply power to the submersible pump motor. A liquid flow path is provided through the spool assembly and is isolated from the electrical circuitry.

1 Claim, 1 Drawing Sheet

SPOOL ASSEMBLY FOR FIELD ADJUSTABLE COLUMN LENGTH PUMP SYSTEMS

FIELD OF THE INVENTION

This invention relates generally to submersible pump systems of the type used in gasoline dispensing installations. More particularly, the invention is directed to a spool assembly which accommodates field adjustment of the column length for the pump system.

BACKGROUND OF THE INVENTION

In pumping systems such as those used in the dispensing of gasoline, a submersible pump is submerged in an underground tank which stores the gasoline. The pump is normally bolted or otherwise attached to a discharge head which connects through a vertical column pipe with a distributor head. The gasoline which is pumped to the distributor head is directed from there to the appropriate dispensing unit. The distributor head also includes electrical connections for the pump. Normally, the electrical lead wires are contained within a conduit which extends between the distributor head and the discharge head. Electrical contacts of the pump are connected with mating contacts of the discharge head to supply electrical power for operating the pump.

Safety regulations require that electrical connections meet prescribed standards. Regulations also require that the electrical system be isolated from the gasoline flow path and that the gasoline flow path exhibit integrity against leakage. Any field assembly of the parts that is required must be conducted in a manner to assure compliance with all of these regulations.

At times, a need arises in the field to change the length of the column in order to accommodate the size and geometry of the particular installation that is involved. However, known systems are not constructed in a manner to allow field adjustment of the column length, and their versatility suffers accordingly.

SUMMARY OF THE INVENTION

The present invention relates to a spool assembly which is used for adjustment of the column length in a submersible pump installation of the type used in gasoline dispensing operations. It is the principal goal of the invention to provide for the field adjustability of the column length. Another aim of the invention is to provide for column length adjustability while assuring compliance with prevailing safety standards regarding electrical connections and fluid chamber integrity.

In accordance with the invention, a spool assembly has a head spool at its top end and a base spool at its bottom end connected by a column pipe which provides a liquid flow path between the two spools. The spool assembly can be installed in the pumping column by detaching the pump from the discharge head, bolting the head spool to the discharge head, and bolting the pump to the base spool. The column pipe in the spool assembly then provides a liquid flow path between the pump and the discharge head.

The spools are each provided with electrical connectors which automatically connect electrically with mating connectors in the pump and discharge head. An electrical conduit extending within the column pipe contains electrical leads which connect with the electrical connectors in the head and base spools. This makes electrical power available for operating the motor of the submersible pump at the bottom of the column. The electrical conduit is isolated from the liquid path by suitable seal elements.

Different spool assemblies are provided with different column pipe lengths. Consequently, the appropriate length can be selected and installed to provide the desired column length for each different pumping installation. The electrical connections are made automatically and comply with the applicable regulations. At the same time, the liquid flow path is sealed against leakage and is isolated from the electrical circuitry.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
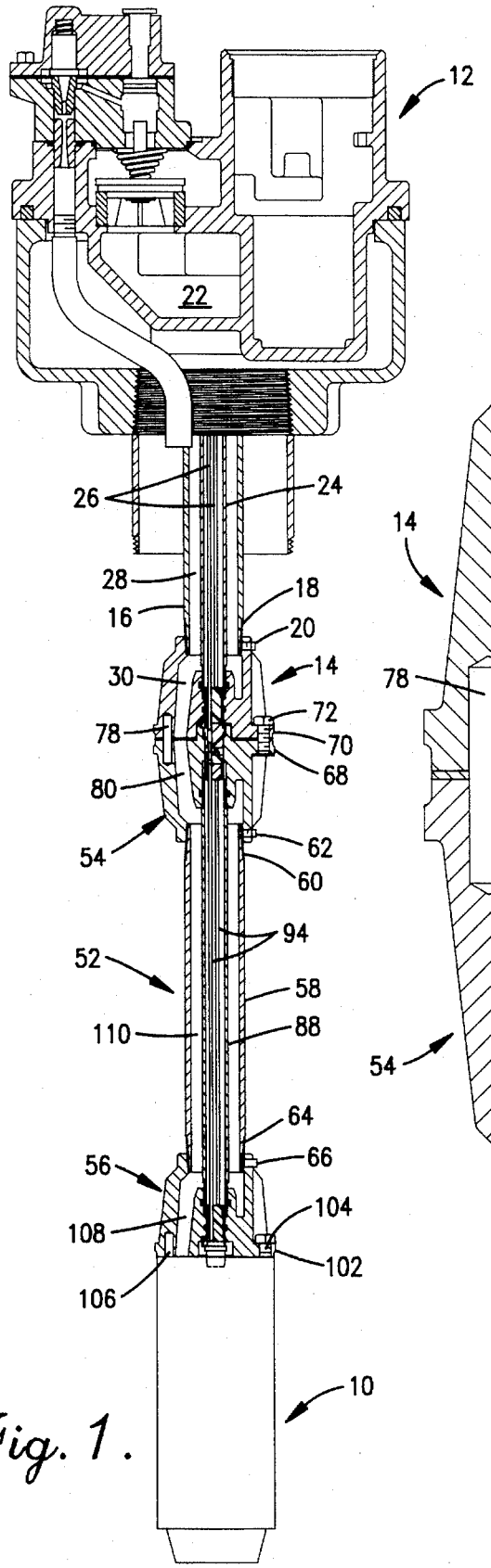
FIG. 1 is a sectional view taken on a vertical plane through a submersible pumping system which is provided with a spool assembly constructed according to a preferred embodiment of the present invention.

Referring now to the drawings in more detail and initially to FIG. 1, numeral 10 generally designates a submersible electric pump/motor unit of the type used in pumping systems which operate to pump gasoline from underground storage tanks to above ground dispensing units. Pumping systems of this type may include a distribution head which is generally identified by numeral 12 and which receives the gasoline pumped by the pump 10 and distributes it to the dispensing unit (not shown). The distribution head 12 is also supplied with electrical power which is used to operate the electric motor of the pump 10.

The distribution head 12 is connected with a discharge head 14 by a vertical column pipe 16. The pipe 16 is connected at its top end with the distribution head 12 and has a threaded connection at 18 with the top of the discharge head 14. A set screw 20 secures the threaded connection 18 between the pipe 16 and discharge head 14. The top end of the pipe 16 communicates with a chamber 22 which is formed within the distribution head and which receives the gasoline that is pumped and distributes it to the dispenser.

An electrical conduit 24 is connected with the distribution head 12 at its top end and extends downwardly within the pipe 16. The conduit 24 is concentric with the larger pipe 16 and contains a plurality of electrical leads 26 which receive the electrical power that is supplied to the distribution head 12. An annular flow passage 28 is formed between the conduit 24 and the pipe 16. The gasoline which is pumped by the pump 10 flows through this flow passage 28 to the chamber 22 in the distribution head.

Figure 2:
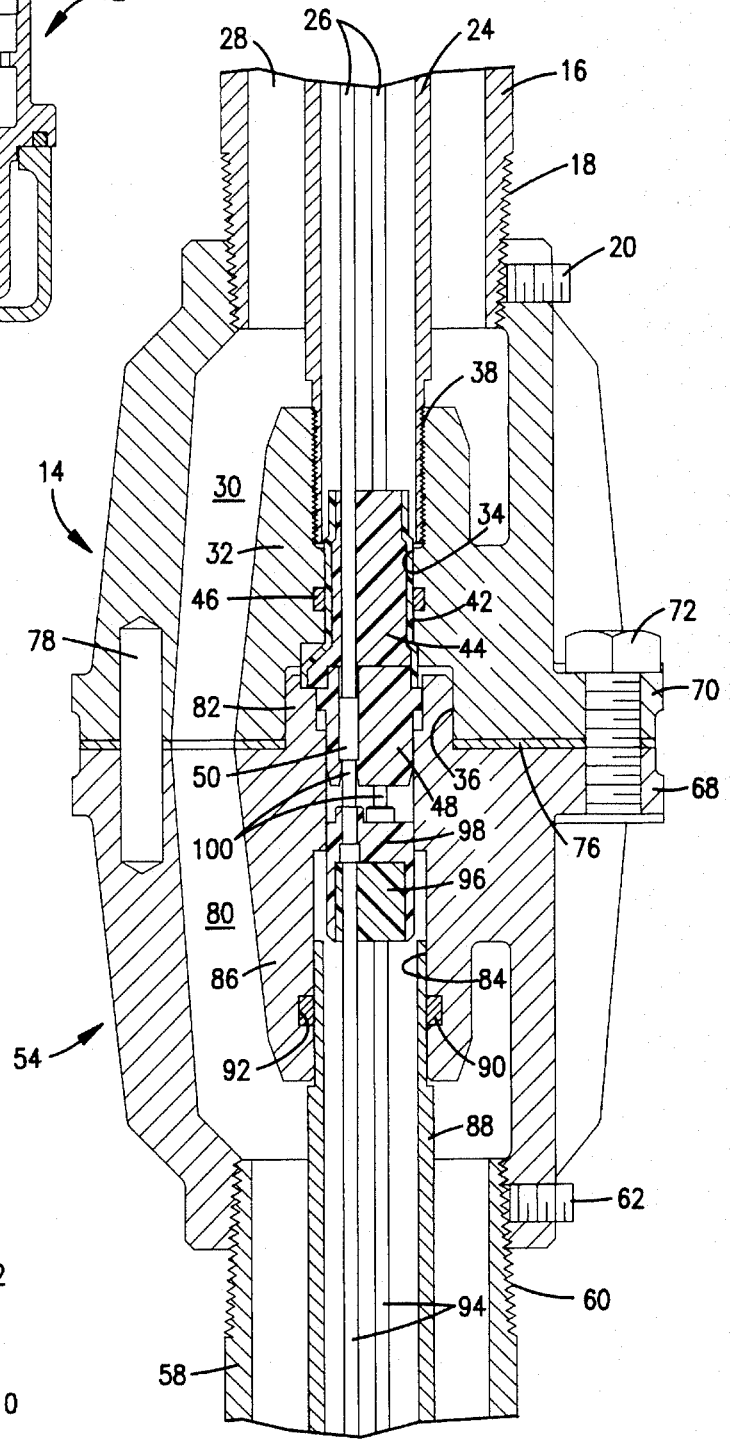
FIG. 2 is a fragmentary sectional view on an enlarged scale showing the portion of FIG. 1 in the area of the connection between the discharge head of the pumping system and the head spool of the spool assembly.

With reference to FIG. 2 in particular, the discharge head 14 provides an internal chamber 30 which communicates with the flow passage 28. The discharge head 14 has the general configuration of a spool and presents an internal gland 32. A passage 34 is formed through the gland 32 along the axial centerline of the discharge head 14. The passage 34 connects at its bottom end with a cylindrical cavity 36 which is formed in the bottom face of the discharge head 14. The upper portion of passage 34 is threaded at 38. The lower end of the conduit 24 has a threaded connection with the threaded passage portion 38.

A metal shell 42 is located in the passage 34 and contains a generally cylindrical block 44 which may be epoxy resin. An O-ring 46 provides a seal between the exterior of the shell 42 and the interior surface of gland 32 which surrounds passage 34. The electrical leads 26 extend through and are encapsulated by the block 44.

Also held by the shell 42 is a generally cylindrical connector 48 which is partially located in the cavity 36. The lower end of the connector 48 extends out of the cavity 36 beyond the lower face of the discharge head 14. The electrical leads 26 extend into the connector 48. The lower end of each lead 26 connects with a tubular receptacle 50 located within the connector 48.

Each of the leads 26 may take the form of an electrically conductive wire surrounded by insulation contained within an outer shell or conduit. Preferably, there are three of the leads 26, each constituting a power wire.

The pump 10 is initially bolted directly to the discharge head 14. When the pump 10 is bolted to the discharge head 14 in the normal manner, the pump discharge connects with the annular flow passage 28 so that liquid is pumped to the distributor head cavity 22 when the pump operates. The motor has projecting pins (not shown) which extend into the receptacles 50 and make electrical contact with the lead wires when the pump is bolted in place, thus providing electrical power for operation of the pump.

In accordance with the present invention, the pump/motor unit 10 may be detached from the discharge head 14, and a spool assembly 52 may be installed between the pump 10 and discharge head 14. The spool assembly 52 includes a head spool 54 on its top end and a base spool 56 on its bottom end. The spools 54 and 56 have configurations similar to that of the discharge head 14. A column pipe 58 extends between the head spool 54 and base spool 56. The pipe 58 has a threaded connection at 60 with the head spool 54. A set screw 62 is threaded into the spool 54 and tightened against the pipe 58 to secure the connection. The pipe 58 is connected at its lower end with the base spool 56 by means of a similar threaded connection 64. A set screw 66 secures the connection.

The head spool 54 has a peripheral flange 68 adjacent to its upper face. The discharge head 14 has a similar flange 70 which overlies the flange 68. A plurality of machine bolts 72 are extended through the flange 70 and threaded to flange 68 in order to connect the head spool 54 with the discharge head 14. A flat gasket 76 (FIG. 2) is located between the faces of the discharge head and head spool in order to provide a fluid tight seal between them. A pin 78 is fitted in a passage that extends partially into the discharge head 14 and partially into the head spool 54 in order to provide a fixed rotative orientation of the spool 54 relative to the discharge head 14.

With reference to FIG. 2 in particular, the head spool 54 has an internal chamber 80 that communicates with the column pipe 58 and with the chamber 30 of the discharge head 14. A boss 82 projects upwardly from the top face of spool 54 and fits closely in the cavity 36 when the head spool is bolted to the discharge head. A passage 84 extends into the boss 82 and through a gland 86 located within the body of the spool 54 and integral with the boss 82.

An electrical conduit 88 extends within the column pipe 58 and is concentric with it. The top end of the conduit 88 extends into the passage 84 in a slip fit. An O-ring 90 is fitted in an annular groove 92 formed in the gland 86 around the wall of passage 84 and provides a seal between the gland 86 and the conduit 88.

A plurality of electrical leads 94 are contained in the conduit 88. The leads 94 extend through and are embedded in an epoxy block 96. The block 96 is connected with an electrical connector 98 which fits closely in the passage 84. Each of the leads 94 may include an electrically conductive wire surrounded by insulation and contained within an outer jacket. Each of the leads 94 has a corresponding pin 100 with which the conductor wire of the corresponding lead connects. The pins 100 project upwardly from the connector 98. They are located such that when the head spool 54 is bolted to the discharge head 14, the pins 100 extend into the receptacles 50 and make electrical connection with the corresponding conductor wires of the leads 26. It is noted that the O-ring 90, the threads 34 and the gasket 76 isolate the electrical components from the gasoline flow path.

The base spool 56 is provided with substantially the same fluid flow path and electrical connections as the discharge head 14. As best shown in FIG. 1, the lower end of the base spool 56 has a peripheral flange 102. A plurality of bolts 104 are extended through the flange and connect the pump 10 to the bottom face of the spool 56. An alignment pin 106 fixes the rotational position of the pump 10 relative to the base spool 56. When the pump 10 is bolted in this fashion to the base spool 56, the electrical connections of the base spool make electrical contact with the mating electrical connections of the pump 10. The leads 94 connect at their lower ends with the electrical connections of the base spool 56 so that electrical power is made available to the pump motor.

In operation, the pump 10 is submerged in the gasoline that is to be dispensed. A flow path for the gasoline is established from the pump discharge through a chamber 108 formed within the base spool 56, through an annular passage 110 formed between the column pipe 58 and electrical conduit 88, through chambers 80 and 30, through the flow passage 28 to the distributor head chamber 22 and then to the dispensing unit. Electrical power is made available for operating the motor of the pump 10 through the leads 26, the receptacles 50, the pins 100, the leads 94 and the mating electrical contacts of the base spool 56 and pump 10. Consequently, the pumping system can be operated in the normal fashion to pump gasoline to the dispensing unit.

It is contemplated that a number of different sizes of the spool assembly 52 will be made available with each different spool assembly having a different length of the column pipe 58, conduit pipe 88 and leads 94. Thus, each spool assembly will have a different overall length. This allows the installer of the system to select whichever spool assembly has the desired length, detach the pump 10 from the discharge head 14, and install the selected spool assembly between the pump 10 and discharge head 14. By selecting a spool assembly having the desired length, the pump 10 can be located at the proper submergence in the tank of the particular facility that is involved. In this way, the overall length of the pumping assembly can be adjusted in the field to accommodate the size and geometry of the pumping installation. At the same time, proper electrical connections and fluid chamber connections are made automatically when the spool assembly is installed, and these connections are in full compliance with the prevailing safety standards and regulations that are applicable.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, what is claimed is:

1. In a pumping installation having an electrically powered submersible pump for pumping gasoline, a distribution head for receiving the gasoline, a discharge head connected with the distribution head by a fluid conduit providing a gasoline flow path, a gland member in the discharge head having a lower face presenting a cavity, an electrical tube extending through said fluid conduit to said gland member, electrical wiring extending through said tube, and an electrical connector element projecting into said cavity and providing an electrical connection to said wiring, the improvement comprising:

a spool assembly including a head spool and a base spool, said spool assembly having a pipe connecting said spools and providing a gasoline flow path from the base spool to the head spool;

means for detachably connecting said head spool to said discharge head, said detachable connecting means including an alignment pin engaging the discharge head and head spool to establish a predetermined rotative alignment therebetween;

a gland in said head spool presenting a projecting boss closely fitting in said cavity;

an electrical conduit extending through said pipe to said gland;

plural electrical conductors extending through said electrical conduit;

an electrical connector on said gland having means for electrical connection with said electrical connector element to establish electrical connection between said wiring and said electrical conductors;

means for sealing said gland and gland member together to isolate said electrical conduit and said electrical tube from the gasoline in said pipe and flow conduit; and means for detachably mounting said pump on said base spool with the pump electrically connected with said conductors to receive electrical power therefrom and with the gasoline pumped by said pump delivered to said pipe.

* * * * *